United States Patent [19]

Lochet et al.

[11] Patent Number: 4,755,264

[45] Date of Patent: Jul. 5, 1988

[54] ELECTROLYTE SOLUTION AND PROCESS FOR GOLD ELECTROPLATING

[75] Inventors: Jean A. Lochet, Metuchen; Raj B. Patel, Piscataway, both of N.J.

[73] Assignee: Vanguard Research Associates, Inc., South Plainfield, N.J.

[21] Appl. No.: 55,420

[22] Filed: May 29, 1987

[51] Int. Cl.[4] ..... C25D 3/56; C25D 3/62

[52] U.S. Cl. ..... 204/44.3; 204/44.5

[58] Field of Search ..... 204/44.3, 44.5

[56] References Cited

U.S. PATENT DOCUMENTS

| | | | |
|---|---|---|---|
| 3,149,058 | 9/1964 | Parker et al. | 204/47.5 |
| 3,149,957 | 9/1964 | Parker et al. | 204/47.5 |
| 3,893,896 | 7/1975 | Korbelak et al. | 204/44 |
| 3,929,595 | 12/1975 | Biberbach et al. | 204/44 |
| 4,069,113 | 1/1978 | Crossley et al. | 204/44.3 |
| 4,075,065 | 2/1978 | Korbelak et al. | 204/44 X |
| 4,436,595 | 3/1984 | Matson | 204/40 |
| 4,615,774 | 10/1986 | Somers et al. | 204/44.3 |
| 4,670,107 | 6/1987 | Lochet | 204/44.3 |

*Primary Examiner*—G. L. Kaplan

*Attorney, Agent, or Firm*—Stefan J. Klauber, Esq.

[57] ABSTRACT

Gold plating baths comprising a nickel or cobalt brightener/hardener, containing oxalic acid and additionally at least one dicarboxylic acid selected from the group consisting of succinic acid, malonic acid, glutaric acid and adipic acid, enable the use of low current densities with improved efficiencies in producing bright deposits; also enable bright deposits to be obtained at high temperatures of about 150° F.

18 Claims, No Drawings

ELECTROLYTE SOLUTION AND PROCESS FOR GOLD ELECTROPLATING

FIELD OF THE INVENTION

This invention relates to the electrodeposition of gold from an aqueous gold cyanide plating bath. More particularly, it relates to obtaining bright gold deposits with excellent physical properties, e.g. without degradation of the quality of the deposit, under plating conditions including the presence of a nickel or cobalt brightener/hardener, especially at low current densities.

BACKGROUND OF THE INVENTION

It can be seen as a matter of economics that high deposition rates are highly desirable, since the higher the production is, the lower the unit cost becomes.

As a general rule, higher gold concentrations permit higher efficiency, current densities and plating rates.

However, for economic reasons (lower inventory, lower drag out, etc.) gold contents should be kept as low as possible.

It will be understood that higher current densities mean higher rates of deposition, since theoretically one ampere will deposit a definite amount of metal in one second. A further consideration is that the current efficiency, expressed as mg/ampere-minute, when reduced to very small values, renders the buildup of thick bright deposits difficult or impossible in high speed applications in which thick deposits have to be built up in a very short time, termed "retention time". That is, the low current efficiency works oppositely to the effect of high current density. Further, as stated in U.S. Pat. No. 4,436,595 at column 3, lines 25–29, the lower the temperature, the brighter the deposit, but the slower the plating speed, and vice versa; and as a compromise between brightness and plating speed, an operating temperature of 130° F. is preferred. In fact, in practice, very few if any known acid gold plating baths give bright deposits at 150° F., whereas, as will be seen in the ensuing description, the reverse is true for the baths of the present invention.

It is an object of the invention to improve plating efficiency at the low end of the range of current densities where high efficiency is generally not obtained, e.g., less than 20 ASF, preferably less than 10 ASF.

The use of nickel or cobalt chelates as brightener/-hardeners is taught in U.S. Pat. Nos. 3,149,057 and '058. The use of aliphatic acids of 2 to 8 carbon atoms such as acetic, citric, tartaric, etc., when properly neutralized to act as buffers to maintain a pH between 3 and 5, is described.

U.S. Pat. No. 3,929,595, which is directed to employing a heterocyclic azohydrocarbon sulfonic acid or salt current extender, and a reduced amount of non-noble metal additions, also discloses the use of a weak organic acid, preferably citric or tartaric acid. It mentions that additional suitable weak organic acids include formic acid, lactic acid, kojic acid, itaconic acid, citraconic acid, gluconic acid, glutaric acid, glycolic acid, acetic acid and propionic acid.

U.S. Pat. Nos. 3,893,896 and 4,075,065 disclose alkali metal gold cyanide plating baths containing a metallic hardener such as cobalt citrate and nickel sulfamate, a Lewis acid such as boric acid, zirconium oxychloride and vanadyl sulphate, and a weak, stable aliphatic acid containing one or more carboxylic acid or hydroxy groups. It discloses as suitable organic acids, itaconic, citraconic, gluconic, glutaric, glycolic, citric, kojic, malic, succinic, lactic, tartaric and mixtures thereof.

U.S. Pat. No. 4,615,774 discloses a citrate-free bath for the electrodeposition of a gold alloy, which bath consists essentially of a bath soluble source of gold in an amount to provide a gold content of 4 to 50 g/l, a bath soluble source of nickel alloying metal in an amount to provide a nickel content of 0.5 to 20 g/l, oxalic acid in an amount of 20 to 100 g/l, and formic acid in an amount of 20 to 100 ml/l.

Also of interest is U.S. Ser. No. 912,171 filed Sept. 25, 1986 and now U.S. Pat. No. 4,670,107 incorporated herein by reference, which discloses a gold plating bath comprising an aqueous solution containing a soluble gold cyanide compound, a water soluble organophosphorous chelating agent, formic acid in a specified concentration, cobalt or nickel which may be introduced as their salts or chelates as brightener/hardeners and sufficient alkali to bring the pH to within a specified range.

As described therein, and as is also true in this application, the plating may be accomplished by any of the commercial means available such as barrel, rack and strip plating equipment and high speed continuous selective plating equipment. The products are useful for industrial purposes, especially for making electrical connections, e.g. as connectors. Depending on the type of equipment used, plating may be carried out at temperatures in the range of 90° to 160° F. and at current densities from about 0.5 to in excess of 1000 ASF.

One problem that arises in connection with said gold plating bath, is that the nickel-containing bath does not work as effectively at low current densities which prevail in barrel-type plating machines of which the Vibrobot, a vibratory unit, is a commercial example. The nickel percentage in the deposit is too high to meet certain specifications, i.e. MIL-G-45204C. For Type 1 deposits there should be 99.7% gold minimum; for Type 2 deposits 99.0% gold minimum. Also, the gold color is too light to be acceptable in connectors, i.e. too "brassy" for these applications. Further, the hardness is outside of acceptable specifications. It is too high to qualify. That is, it is above 200 Knoop so as not to meet grade C in the connector industry. It should be noted that reducing the nickel content in the bath does not reduce the hardness sufficiently; there is simply a loss of brightness. That is an unacceptable solution. There is a further difficulty when said bath is intended for use in a Vibrobot machine which arises from the fact that the machine has closed tanks plus the fact that it is customary in the art to use a replenisher. However, when employing formic acid, the replenisher is liquid and the conductivity medium is also liquid. Consequently the bath increases in volume. Therefore, there is a tendency to overflow. A new bath with solid replenisher and solid conductivity salts is desirable owing to the higher specific gravity. Of course, good solubility of the materials in the aqueous bath is necessary. The following table shows the physical properties of some dibasic acids.

TABLE

PHYSICAL CONSTANTS OF DIBASIC ACIDS

| Name | Formula | M.P. °C. | Sol. g./100 g. $H_2O$ | $K_1$ | $K_2$ |
|---|---|---|---|---|---|
| Oxalic | HOOC—COOH | 189. | $10.2^{20}$ | $5.7 \times 10^{-2}$ | $6.9 \times 10^{-5}$ |
| Malonic | HOOC—$CH_2$—COOH | 135.6 | $139.4^{15}$ | $1.7 \times 10^{-3}$ | $1.0 \times 10^{-6}$ |
| Succinic | HOOC—$(CH_2)_2$COOH | 185. | $6.84^{20}$ | $6.65 \times 10^{-5}$ | $2.3 \times 10^{-6}$ |
| Glutaric | HOOC—$(CH_2)_3$COOH | 97.5 | $83.3^{14}$ | $4.75 \times 10^{-5}$ | $2.7 \times 10^{-6}$ |
| Adipic | HOOC—$(CH_2)_4$COOH | 151. | $1.44^{15}$ | $3.76 \times 10^{-5}$ | $2.4 \times 10^{-6}$ |
| Pimelic | HOOC—$(CH_2)_5$COOH | 103. | $4.1^{20}$ | $3.48 \times 10^{-5}$ | $3.23 \times 10^{-6}$ |
| Suberic | HOOC—$(CH_2)_6$COOH | 140. | $0.142^{15.5}$ | $2.99 \times 10^{-5}$ | $2.5 \times 10^{-6}$ |
| Azelaic | HOOC—$(CH_2)_7$COOH | 106.5 | $0.214^{20}$ | $2.96 \times 10^{-5}$ | $2.7 \times 10^{-6}$ |
| Sebacic | HOOC—$(CH_2)_8$COOH | 134.5 | 0.10 | $2.34 \times 10^{-5}$ | $2.6 \times 10^{-6}$ |

Accordingly it is a further object of the invention to provide an improved bath for electrodepositing gold containing a nickel or cobalt hardener which will be highly effective at low current densities, i.e. will operate at higher efficiency and give a more flexible product, especially with nickel, and which enables a solid replenisher to be used.

SUMMARY OF THE INVENTION

According to the invention a bath is provided for producing deposits of gold by electrodeposition, comprising an aqueous solution containing at least one soluble gold cyanide compound, oxalic acid in a concentration of from about 5 to about 50 grams per liter (preferably from about 10 to 20 g/l) of the bath solution, a dicarboxylic acid selected from the group consisting of malonic acid, succinic acid, glutaric acid and adipic acid and mixtures thereof, a brightener/hardener selected from the group consisting of nickel and cobalt compounds, and sufficient alkali to bring the pH to within the range of about 3.5 to about 4.8, and more preferably to the range of 3.8 to 4.2. Thus the dicarboxylic acid is selected from a homologous series and may be represented by the formula $HOOC(CH_2)_n$—COOH in which in is an integer from 1 to 4.

The concentration of the oxalic acid within the range specified, is critical. A concentration above about 50 g/l tends to prevent nickel or cobalt from functioning as a brightener in appropriate fashion. This deposit can become dull. The concentration of the malonic acid, succinic acid, glutaric acid and adipic acid is not particularly critical, but in general is from about 30 to 150 grams per liter of the bath solution, but within the solubility limits of said dicarboxylic acid in the bath solution.

The cobalt or nickel may be introduced as their salts or chelates. A chelating agent, either combined with said metal or in free form, is not essential. When replenisher, i.e. oxalic acid and/or one of the higher molecular weight dicarboxylic acids specified, is added, it is preferably introduced in solid form.

Although gold concentrations (calculated as metal) may range from about 2 g/l to about 20 g/l, the lower concentrations are more economic and may range from about 2 g/l to about 4 g/l.

The temperature of plating may be in the range of about 90° F. to about 160° F.

When barrel plating is used, a temperature of about 90° F. to about 110° F. is employed, a gold metal content of about 2 g/l to about 4 g/l and a current density of at least about 0.5 ASF but generally in the lower range of current densities.

With the novel, improved plating baths of the invention, one can control the cobalt and nickel to lower levels to meet MIL specifications and still obtain a more flexible product, especially with nickel. The hardness with low nickel baths is around 160 Knoop, which is acceptable. High throwing power at low current densities is achieved, which is unexpected. This is especially useful for plating connectors with deep recesses or with blind holes. Where nickel-containing baths are used, exceptionally good solderability is obtained.

DETAILED DESCRIPTION

The invention will be described with reference to the ensuing tests and Examples, which are intended to be illustrative but not limitative.

The testing method used basically employs a 1 liter beaker with platinum coated anodes, a thermostatically controlled heater, a means to provide mild agitation and a suitable rectifier in which are plated copper panels except that in Examples V to VI, copper wires of about 1 mm in diameter and 320 mm in length turned around a wood cylinder of 2 mm in diameter, are used.

In general, formulas are prepared by mixing the ingredients, adjusting the pH with KOH to within the preferred range of about 3.8 to about 4.2 and adding water to bring the volume to 1 liter. Data are given for temperature, ASF (amperes per square foot), efficiency in mg (milligrams per ampere-minute) and appearance.

EXAMPLE 1

| | Formula A 1 liter | |
|---|---|---|
| oxalic acid | 15 g | pH = 3.65 |
| succinic acid | 50 g | |
| citric acid | 75 g | |
| di-ammonium citrate | 150 g | |
| Ni as sulfate | 400 mg | |
| Au | 4.2 g | |
| pH (final composition) | 3.8 | |

Panels were plated at 100° F. at the current densities shown. The efficiencies and aspects were noted.

| ASF | 2.2 | 5 | 10 |
|---|---|---|---|
| Efficiency, mg | 66.33 | 50.2 | 34.75 |
| Aspect | very bright | very bright | bright but agitation sensitive - needs more nickel |

EXAMPLE II

In this series of tests, the concentration of succinic acid is the variable in order to evaluate its effect on the bath performance. In the tests subsequent to the first, Au was replenished back to 6 g/l. Panels were plated at 100° F.

| Formula B | | | | |
|---|---|---|---|---|
| | 1 liter | | | |
| | (1) succinic acid: 10 g/l | | | |
| | oxalic acid | 15 g | | |
| | succinic acid | 10 g | | pH = 3.76 |
| | citric acid | 75 g | | |
| | di-ammonium citrate | 160 g | | |
| pH adjusted | nickel-metal | 700 mg | | (5 ml) |
| from 3.76 to | Au | 6 g | | |
| 4.0 with | pH | 4.0 | | |
| 17 g KOH | sp. gr | 16° | | |
| ASF | 2.2 | 5 | 10 | 20 |
| Efficiency, mg | 63.3 | 58.9 | 48.5 | 28.4 |
| Aspect | very bright | very bright | bright | 80% burnt |
| | (2) succinic acid: 20 g/l | | | |
| ASF | 2.2 | 5 | 10 | 20 |
| Efficiency, mg | 61.5 | 55.2 | 47.2 | 27.2 |
| Aspect | very bright | very bright | 90% bright | 70% burnt |
| | (3) succinic acid: 30 g/l - pH adjusted to 4.0. | | | |
| ASF | 2.2 | 5 | 10 | 20 |
| Efficiency, mg | 56.1 | 53.9 | 44.6 | 27 |
| Aspect | fully bright | fully bright | bright; slight haze on edge | 70% burnt |
| | (4) succinic acid: 40 g/l | | | |
| ASF | 2.2 | 5 | 10 | 20 |
| Efficiency, mg | 58.8 | 52.4 | 44.1 | 27 |
| Aspect | fully bright | fully bright | 90% bright | 60% bright |

As the succinic acid content is increased, the efficiency of the deposit decreases slightly (approximately 1 to 2 mg per 10 g of succinic acid per liter) consistently in the 5 to 20 ASF range.

EXAMPLE III

The effect of using a decreased concentration of oxalic acid was studied in this test. Panels were plated at 100° F.

| Formula C | | | | |
|---|---|---|---|---|
| | 1 liter | | | |
| oxalic acid | 10 g | | | |
| succinic acid | 50 g | | | pH = 3.65 |
| citric acid | 75 g | | | |
| di-ammonium citrate | 150 g | | | |
| Ni as sulfate | 400 mg | | | |
| Au | 4.2 g | | | |
| pH | 3.8 | | | |
| sp. gr. | 16° | | | |
| ASF | 2.2 | 5 | 10 | 20 |
| Efficiency, mg | 47.5 | 46.5 | 36.6 | 23.6 |
| Aspect | fully bright | fully bright | fully bright | 75% bright; 25% burnt |

EXAMPLE IV

| Formula D | |
|---|---|
| | 1 liter |
| oxalic acid | 15 g |
| malonic acid | 50 g |
| citric acid | 75 g |
| di-ammonium citrate | 150 g |
| Ni as sulfate | 400 mg |
| Au | 4.2 g |
| pH | 3.8 |

-continued

Plating was carried out at 100° F.

| ASF | 2.2 | 5 | 10 | 20 |
|---|---|---|---|---|
| Efficiency, mg | 66.1 | 51.7 | 39.2 | 21.6 |
| Aspect | very bright | very bright | bright but burnt on one edge of panel | semi-bright but burnt on one edge |

EXAMPLE V

Tests were carried out using a formula similar to Formula D but with an Au concentration of 10 g/liter, on the aforementioned copper wires at 150° F.

| ASF | 20 | 40 | 60 | 80 | 120 |
|---|---|---|---|---|---|
| Efficiency, mg | 49 | 50 | 40.4 | 34 | 22.5 |
| Aspect | semi-bright to dull | fully bright | bright | semi-bright | semi-bright |

EXAMPLE VI

The tests of Example V were repeated using a formula similar to Formula D but with an Au concentration of 20 g/liter, on the aforementioned copper wires at 150° F.

| ASF | 20 | 40 | 60 | 80 | 120 |
|---|---|---|---|---|---|
| Efficiency, mg | 48.7 | 52.5 | 53.8 | 50.7 | 42.5 |
| Aspect | fully bright | very bright | very bright | fully bright | semi-bright to dull |

In co-pending application U.S. Ser. No. 912,171 filed Sept. 25, 1986, it is mentioned that citric acid had a detrimental effect as a replacement for formic acid in high speed plating baths in which formic acid was used as a current extender. However, citric acid is perfectly acceptable for low current densities applications such as barrel and rack plating.

In U.S. Pat. No. 2,905,601, Rinker and Duva's citrate type of plating bath and variations thereof, have been for a long time the standard for barrel or rack applications. Such a typical bath was prepared:

EXAMPLE VII

| | 1 liter |
|---|---|
| Citric acid | 150 grams |
| Di-ammonium citrate | 120 grams |
| Ammonium hydroxide | about 40 ml |
| Nickel (as citrate) | 400 mg |
| Gold (as PGC)* | 4 grams |
| pH | 4.0 |

*PGC is potassium gold cyanide.

Panels were plated at 100° F. at the current densities shown. The efficiencies and aspect of the resulting plates were noted:

| ASF | 2.2 ASF | 5 ASF | 10 ASF |
|---|---|---|---|
| Efficiency, mg | 54 | 58.5 | 47 |
| Aspect of Deposit | bright | bright | semi-bright to hazy |

The current densities were chosen because they are excellent check points to determine the ability of a plating bath to cover deep recesses (throwing power) and to have good distribution. Applicant has noted that in a given cobalt or nickel hardened gold bath, if the efficiency at 2.2 ASF is higher than that at 5 and 10 ASF, the the higher the throwing power. Furthermore, when a bath shows such characteristics, the so-called dogboning effect in which more metal is plated in the high current densities areas than in the low current densities areas is simply reversed resulting in significant gold savings, an extremely important point to today's plater.

According to that criterion, the above test does not show particularly good throwing power or distribution. The nickel content of the deposit plated at 5 ASF was 0.28%. Potassium salts versions give about the same results.

EXAMPLE VIII

To the above bath a dicarboxylic acid such as succinic acid can be added. A bath of the following formula was used.

| Formula E | 1 liter |
|---|---|
| Citric acid | 75 grams |
| Succinic acid | 50 grams |
| Diammonium citrate | 160 grams |
| Nickel (as sulfate) | 300 mg |
| pH (adjusted with ammonia) | 3.8 |
| Au (as PGC) | 4.2 grams |

Panels were plated at 100° F. at the current densities shown. The efficiencies and aspect of the resulting plates were noted:

| ASF | 2.2 ASF | 5 ASF | 10 ASF |
|---|---|---|---|
| Efficiency, mg | 46.6 | 49.8 | 37.4 |
| Aspect of deposit | bright | bright | semi-bright |

The nickel content of the deposit plated at 5 ASF was 0.40%. The formulation does not show any improvement over that of the preceding example.

EXAMPLE IX

When 15 grams of oxalic acid were added to the bath of Example VIII, the result is somewhat dfferent. Panels were plated at 100° F. at the current densities shown. The efficiencies and aspect of the resulting plates were noted:

| ASF | 2.2 ASF | 5 ASF | 10 ASF |
|---|---|---|---|
| Efficiency, mg | 60.5 | 52.3 | 38.2 |
| Aspect of deposit | bright | bright | bright with haze |

The nickel content of the deposit plated at 5 ASF was 0.167%, hence significantly lower than in Examples VII and VIII. In addition, the efficiency at 2.2 ASF and 5 ASF was unexpectedly increased, resulting in a much better throwing power and distribution when a large bath of similar formulation was used in a barrel plating line. Once more, the results are completely unexpected.

EXAMPLE X

Similar results are obtained when malonic acid is used instead of succinic acid, as in the following series of tests.

(1) In the bath of Example VIII, succinic acid was replaced by malonic acid. The bath had the following formula.

| Formula F | |
|---|---|
| Citric acid | 75 grams |
| Malonic acid | 50 grams |
| Diammonium citrate | 160 grams |
| Nickel (as sulfate) | 300 mg |
| pH (adjusted with ammonia) | 3.8 |
| Au (as PGC) | 4 grams |

Panels were plated at 100° F. at the current densities shown below:

| ASF | 2.2 ASF | 5 ASF | 10 ASF |
|---|---|---|---|
| Efficiency, mg | 51.8 | 55.9 | 37.8 |
| Aspect of deposit | bright | bright | semi-bright |

The nickel content in the deposit was 0.4%

(2) 15 grams of oxalic acid were added to the bath. Panels were plated at 100° F. at the current densities shown.

| ASF | 2.2 ASF | 5 ASF | 10 ASF |
|---|---|---|---|
| Efficiency, mg | 74 | 56.4 | 34.9 |
| Aspect of deposit | Semi-bright to bright | Semi-bright with haze | dull |

The nickel content of the deposit plated at 5 ASF was 0.133%. The deposits show too low a nickel concentration in the bath.

(3) Nickel was increased to 600 mg. Panels were plated at 100 ° F. at the current densities shown:

| ASF | 2.2 ASF | 5 ASF | 10 ASF |
|---|---|---|---|
| Efficiency, mg | 53.5 | 46.5 | 32.5 |
| Aspect of deposit | bright | bright | bright |

The nickel content of the deposit plated at 5 ASF was 0.213%. The deposits are now fully bright.

EXAMPLE XI

A bath similar to that of Example VIII was prepared, 300 mg of cobalt being substituted for the nickel. The formula was:

| Formula G | 1 liter |
|---|---|
| Citric acid | 75 grams |
| Succinic acid | 50 grams |
| Diammonium citrate | 160 grams |
| Co (as sulfate) | 300 mg |
| pH (with ammonia) | 4.0 |
| Au (as PGC) | 4 grams |

Panels were plated at 100° F. At the current densities shown. The efficiencies and aspect of the resulting plates were noted:

| ASF | 2.2 ASF | 5 ASF | 10 ASF |
|---|---|---|---|
| Efficiency, mg | 55.5 | 56.3 | 40.3 |
| Aspect of deposit | bright | bright | bright (slight haze) |

The cobalt content of the deposit plated at 5 ASF was 0.136%. No improvement over that of Examples VII and VIII is shown.

EXAMPLE XII 15 grams per liter of oxalic acid were added to the bath of Example XI. Then panels were plated at 100° F. at the current densities shown. The efficiencies and aspect of the resulting plates were noted:

| ASF | 2.2 ASF | 5 ASF | 10 ASF |
|---|---|---|---|
| Efficiency, mg | 80.8 | 68.8 | 42.2 |
| Aspect of deposit | Semi-bright | Semi-bright | Semi-bright with haze |

The cobalt content of the deposit plated at 5 ASF was 0.1%. The increase in efficiency at 2.2 and 5 ASF is significantly higher than that of Example XI.

EXAMPLE XIII

In Example XII, the panels plated at 2.2 and 5 ASF are not fully bright, which shows too low a cobalt concentration. Consequently the cobalt was increased to 600 mg per liter, then panels were plated at 100° F. at the current densities shown. The efficiencies and aspect of the resulting plates were noted:

| ASF | 2.2 ASF | 5 ASF | 10 ASF |
|---|---|---|---|
| Efficiency, mg | 62.8 | 55.5 | 37.4 |
| Aspect of deposit | bright | bright | bright |

All the panels were now fully bright. The efficiency at 2.2 and 5 ASF is still higher than that at 10 ASF showing again an excellent distribution, which is confirmed by practical applications in barrel plating. The cobalt content of the deposit plated at 5 ASF was 0.123%.

EXAMPLE XIV

Malonic acid was substituted for succinic acid in the bath of Example XI, Formula G. The panels were plated at 100° F. at the current densities shown. The efficiencies and aspect of the resulting plates were noted:

| ASF | 2.2 ASF | 5 ASF | 10 ASF |
|---|---|---|---|
| Efficiency, mg | 59.6 | 62.6 | 42.5 |
| Aspect of deposit | bright | bright | bright |

The deposit was fully bright. The cobalt content of the deposit plated at 5 ASF was 0.167%.

EXAMPLE XV 15 grams of oxalic acid were added to the bath of Example XIV, and the pH adjusted to 4.0. Panels were plated and the results are reported below:

| ASF | 2.2 ASF | 5 ASF | 10 ASF |
|---|---|---|---|
| Efficiency, mg | 87.6 | 69.7 | 42.9 |
| Aspect of deposit | semi-bright hazy | semi-bright hazy | bright |

As in Example XII, after the addition of oxalic acid, the deposits plated at 2.2 and 5 ASF were not fully bright, showing a starvation in cobalt ions. Again, the efficiencies at 2.2 and 5 ASF were much higher that that at 10 ASF. The cobalt content was 0.1%. These results are completely unexpected.

EXAMPLE XVI

As in Example XIII, the cobalt content was increased to 600 mg. Panels were plated at 100° F. at the current densities shown. The efficiencies and aspect of the resulting plates were noted:

| ASF | 2.2 ASF | 5 ASF | 10 ASF |
|---|---|---|---|
| Efficiency, mg | 67.8 | 60 | 38.5 |
| Aspect of deposit | bright | bright | bright |

As in Example XIII the deposits were now fully bright. In addition it should be noted that the efficiency at 2.2 and 5 ASF is about 8 mg per ampere-minute higher than that of Example IX. The cobalt in the deposit at 5 ASF was found to be 0.136%.

EXAMPLE XVII

Similar results are obtained when the malonic acid or the succinic acid of the above examples is replaced by 50 grams of adipic acid, as in the following series of tests.

(1) Adipic acid replacing malonic (or succinic) acid. Panels were plated at 100° F. at the current densities shown:

| ASF | 2.2 ASF | 5 ASF | 10 ASF |
|---|---|---|---|
| Efficiency, mg | 58.3 | 61.6 | 38.6 |
| Aspect of deposit | bright | bright | bright |

The cobalt content of the deposit plated at 5 ASF was 0.144%.

(2) 15 grams per liter of oxalic acid were added, then panels were plated at 100° F. at the current densities shown:

| ASF | 2.2 ASF | 5 ASF | 10 ASF |
|---|---|---|---|
| Efficiency, mg | 88.6 | 64.3 | 38.4 |
| Aspect of deposit | bright with a slight haze | bright | bright |

The cobalt of the deposit plated at 5 ASF was 0.089%. The efficiency at 2.2 ASF is significantly higher than that of Examples XI and XIV.

(3) The cobalt was increased to 600 mg and panels were plated at 100° F. at the current densities shown:

| ASF | 2.2 ASF | 5 ASF | 10 ASF |
|---|---|---|---|
| Efficiency, mg | 71.5 | 57.8 | 36.5 |
| Aspect of deposit | bright | bright | bright |

The cobalt content of the deposit plated at 5 ASF was 0.168%. In considering the efficiencies at 2.2, 5 and 10 ASF and the aspect of the resulting plated panels, the combination of Example XVII, test (3), appears to be the best with cobalt.

It can be seen from the foregoing that the gold plating baths of this invention containing oxylic acid and additionally a dicarboxylic acid selected from the homologous series from malonic acid to adipic acid, enable the use of low current densities with improved efficiencies in producing bright deposits; and also enable bright deposits to be obtained at high temperatures of about 150° F.

What is claimed is:

1. A bath for producing deposits of gold by electrodeposition comprising an aqueous solution containing at least one soluble gold cyanide compound, oxylic acid in a concentration of from about 5 to about 50 grams per liter of said bath solution, a dicarboxylic acid having the formula HOOC—$(CH_2)_n$—COOH in which n is an integer from 1 to 4 or mixtures thereof, a hardener selected from the group consisting of nickel and cobalt compounds and sufficient alkali to bring the pH to within the range of about 3.5 to about 4.8.

2. A bath in accordance with claim 1, wherein the pH is in the range of from about 3.8 to 4.2.

3. A bath as set forth in claim 1 in which the concentration of said dicarboxylic acid is within the range of about 30 to about 150 grams per liter of the bath solution but within the solubility limits of said dicarboxylic acid in the bath solution.

4. A bath as set forth in claim 1 in which the dicarboxylic acid is succinic acid.

5. A bath as set forth in claim 1 in which the dicarboxylic acid is malonic acid.

6. A bath as set forth in claim 1 in which the dicarboxylic acid is adipic acid.

7. A bath as set forth in claim 1 in which a nickel compound is used.

8. A bath as set forth in claim 1 in which a cobalt compound is used.

9. A bath as set forth in claim 1 in which the gold metal content is within the range of about 2 grams per liter to about 20 grams per liter.

10. A bath as set forth in claim 1 in which the gold metal content is within the range of about 2 grams per liter to about 4 grams per liter.

11. A method of electrodepositing gold which comprises electrolyzing a solution comprising water, 2–20 grams per liter of gold added as an alkali gold cyanide, oxalic acid in a concentration in the range of about 10 to about 20 grams per liter of the solution, a dicarboxylic acid having the formula HOOC—$(CH_2)_n$—COOH in which n is an integer from 1 to 4 or mixtures thereof, a hardener selected from the group consisting of nickel and cobalt compounds and sufficient alkali to bring the pH to within the range of about 3.5 to about 4.8, said method being carried out at a temperature within the range of about 90° F. to about 160° F. and a current density of at least about 0.5 ASF.

12. A method in accordance with claim 11, wherein said pH is in the range of 3.8 to 4.2.

13. A method as set forth n claim 12 in which the temperature is in the range of about 90° to about 110° F.

14. A method as set forth in claim 12 in which the current density is in the range of about 2 to about 120 ASF.

15. A method as set forth in claim 12 in which the current density is in the range of about 2 to less than 10 ASF.

16. A method as set forth in claim 12 in which the electrodeposition is carried out in a barrel type plating machine.

17. A method as set forth in claim 12 in which, when replenishing any of said acids is needed, it is added in solid form.

18. A method of electrodepositing gold in a barrel type plating machine which comprises electrolyzing a solution comprising water, 2–20 grams per liter of gold added as an alkali gold cyanide, oxalic acid in a concentration in the range of about 5 to about 50 grams per liter of the solution, a dicarboxylic acid having the formula HOOC—$(CH_2)_n$—COOH in which n is an integer from 1 to 4 or mixtures thereof in a concentration of about 30 to about 150 grams per liter of the bath solution but within the limits of solubility of said dicarboxylic acid in the bath solution, a hardener selected from the group consisting of nickel and cobalt compounds and sufficient alkali to bring the pH to within the range of about 3.8 to about 4.2, said method being carried out at a temperature within the range of about 90° to about 110° F. and a current density in the range of about 2 to about 20 ASF.

* * * * *